United States Patent [19]

Frischknecht et al.

[11] Patent Number: 4,934,444

[45] Date of Patent: Jun. 19, 1990

[54] DEVICE AND METHOD FOR COOLING ROLLS

[75] Inventors: Bruno Frischknecht; Rudolph Roder, both of Gwatt, Switzerland

[73] Assignee: Lauener Engineering, Ltd., Thun, Switzerland

[21] Appl. No.: 267,012

[22] Filed: Nov. 4, 1988

[51] Int. Cl.[5] ..... B22D 11/06; B22D 11/124

[52] U.S. Cl. ..... 164/480; 72/201; 164/428; 164/443; 164/485

[58] Field of Search ..... 164/480, 485, 428, 443; 72/201, 236

[56] References Cited

U.S. PATENT DOCUMENTS

| | | | |
|---|---|---|---|
| Re. 21,261 | 11/1939 | Hazelett | 164/428 X |
| 49,053 | 7/1865 | Bessemer | 164/485 X |
| 2,075,394 | 3/1937 | Hazelett | 164/480 X |
| 3,670,400 | 6/1972 | Singer | 164/480 X |
| 3,757,847 | 9/1973 | Sofinsky et al. . | |
| 4,061,010 | 12/1977 | Stock et al. | 72/201 |
| 4,422,318 | 12/1983 | Christ et al. | 72/200 |
| 4,614,220 | 9/1986 | Savage | 164/485 X |
| 4,653,303 | 3/1987 | Richard | 72/236 |
| 4,671,091 | 6/1987 | Atack et al. | 72/45 |

FOREIGN PATENT DOCUMENTS

| | | | |
|---|---|---|---|
| 55925 | 11/1968 | German Democratic Rep. . | |
| 57-177863 | 11/1982 | Japan | 164/485 |
| 429005 | 5/1935 | United Kingdom | 164/428 |
| 645305 | 10/1950 | United Kingdom | 164/430 |

OTHER PUBLICATIONS

Abstract of Japanese Patent Publication 58-176009, published Oct. 15, 1983.

Abstract of Japanese Patent Publication 60-231511, published Nov. 18, 1985.

*Primary Examiner*—Nicholas P. Godici

*Assistant Examiner*—J. Reed Batten, Jr.

*Attorney, Agent, or Firm*—Sheridan, Ross & McIntosh

[57] ABSTRACT

The device serves to cool rolls (10, 12), especially in continuous strip casting and in rolling metals. The rolls are covered by hoods, each of which extends from the vicinity of roll nip (26) over a portion of roll surface (28). Spray devices are also provided for supplying a cooling medium (56) to parts of the roll surface. Liquid cooling medium (56) is collected and carried away in the lower part of hood (30). Hoods (30) are sealed off from the corresponding rolls (10, 12). A plurality of spray devices (32) in hood (30) serves to supply an at least partly liquid cooling medium (56) and extends axially over the entire length of the roll. Devices for removing liquid cooling medium (56) from roll surface (28) conduct the latter into a drain or suction device. Spray devices (32) and devices for removing cooling medium (56) are arranged individually or alternately in groups, with removal devices provided at both ends to remove cooling medium (56). Roll surface (28) is preferably cooled with increasing intensity in the direction away from roll nip (26).

58 Claims, 5 Drawing Sheets

DEVICE AND METHOD FOR COOLING ROLLS

The invention relates to a device for cooling rolls, especially in continuous strip casting and in rolling of metals. The rolls are each equipped with a hood extending from the vicinity of the roll nip over a portion of the roll surface and sealed off from the roll, which means are provided to supply a cooling medium to parts of the roll surface and to remove it from the latter, as well as a dispensing and suction device for the liquid cooling medium that collects in the lower part of the hood. The invention also relates to a method for operating the device.

In continuous strip casting of metals between two rolls, for example, the casting mold is essentially formed by the casting nip between the rolls and by lateral sealing walls. The operating time of the rolls is relatively short; a large amount of heat must be carried away over a short distance, especially the heat produced by solidification, friction, and/or working. For this purpose the rolls are cooled by special devices or methods, namely by external spraying or internal cooling.

For operational reasons, the individual skilled in the art prefers that strip-casting facilities be equipped with internally cooled rolls, with cooling channels located as a rule between a roll core and a roll jacket, through which channels a cooling medium flows. This cooling medium (water, as a rule) carries away from the roll jacket the heat, which it absorbs. Considerable care must be devoted to the arrangement of cooling channels, since they are not only responsible for the amount of heat carried away from the material to be cooled, but can also determine the shape or dimensions of the roll itself during operation. If a roll is cooled to different degrees along its length or over its circumference, stresses will be created by differences in thermal expansion and may in turn cause among other things, bending of the roll to varying degrees, which in turn has a negative effect on the quality of the rolled stock. In particular, however, emphasis should be placed on uniform or pre-programmed cooling of the cast material, both lengthwise and transversely.

One advantage of all known designs employing internal cooling is that water is prevented from contacting the rolled stock from the outset, something which can be especially important in roll casting. Thus, for example, in strip casting of aluminum, contact with water produces a violent reaction that leaves traces in the surface of the rolled stock or can even lead to accidents.

The efficiency of internal cooling is, however, limited by the fact that the heat must pass through the roll jacket from the surface of the roll to the cooling medium.

U.S. Pat. No. 4,422,318 teaches a roll with a cooling or heating device for the roll surface. This device has one or more chambers open on the side facing the roll surface. The chambers have an essentially square cross section. A liquid is introduced through the inlet channels. During operation of the rolls, areas of turbulence form in the chambers. This turbulence causes the liquid to remain in the chambers longer, thus producing a greater cooling or heating effect. Although this turbulence increases efficiency, this system is not appropriate for efficient roll casting, for example. New materials and high production rates also demand increased removal of heat with minor stress on the material.

JP-A No. 57-177863 teaches a device for externally cooling a roll in a roll-casting installation for vertically cast thin strip. A hood, located next to the roll nip along the jacket suface of the roll, contains spray nozzles for water and air-supply nozzles. Wiping devices and compressed air prevent any remaining water from escaping from the hood and hence prevent contact between water and the molten metal. No suction device for the cooling medium is provided. On the other hand, separating panels located near the side walls of the hood are pressed by spring force against the roll to prevent leakage.

The inventors have set themselves the goal of creating a device and a method of the type recited hereinabove which allow the advantages of efficient external cooling with higher efficiency to be used, but processing must be accomplished by simple means, and, as in the case of internal cooling, there must be no adverse effect on the cast or rolled strip.

The goal according to the invention is achieved with regard to the device by virtue of the fact that a plurality of spray devices extending axially over the entire length of the rolls is provided in a hood for supplying an at least partly liquid cooling medium together with means for removing the liquid cooling medium from the roll surface, individually or alternating in group, with means located endwise on both sides for removing the cooling medium.

Essentially three known means extending over the entire length of the rolls are used to remove the liquid cooling medium from the roll surface, said means being individual or combinable with one another as desired.

- suction elements, U-shaped in cross section and closed on the sides, with the opening directed toward the roll,
- wipers or sealing strips, resting against the roll or—in conjunction with a vacuum created inside the hood—located, for example, 0.1 mm distant from it,
- compressed-air nozzles or compressed-air slots disposed on strips.

The means provided at both ends for removing cooling medium ensure that no liquid cooling medium reaches the cast or rolled strip. This is of critical importance especially in strip casting, with or without cladding strips.

To further ensure coolant-free contact of the rolls with the rolled stock, the end of the hood away from the roll nip is preferably designed as a drying chamber, with hot or cold air used for drying, for example.

In the rotation direction of the rolls, the hood can have a cleaning and distributing device for parting agents and/or lubricants, especially a brush or a bar that can act on the surface of the roll.

In addition, in the rotation direction of the rolls, downstream from the hood or cleaning brushes or cleaning bar, a spray device to apply a parting agent and/or lubricant, preferably a blackwash or rolling oil, can be mounted. The blackwash can be a graphite suspension, for example.

The roll geometry and strip profile transverse to the rolling direction can be influenced by zone cooling, with the hood subdivided by radial partitions. The resultant chambers can be supplied with different amounts of cooling medium, cooling media with different thermal capacities, and/or coolants with different temperatures.

The method of operating the device is characterized by the roll surface being cooled with greater intensity in the direction away from the roll nip.

Cooling of the surfaces of the two rolls with an intensity that increases with distance from the roll nip is accomplished, essentially analogously to zone cooling, by the following measures which can also be used in combination:

- application of an increasing amount of cooling medium.
- application of cooling media with increasing thermal capacity.
- application of cooling media with decreasing temperatures.

It has been found especially advantageous to apply the following media to the roll surfaces in the direction away from the roll nip: a sprayed mixture of water and air, water, and finally drying air. Dry or moist air can also be applied at the outset.

Externally cooled rolls can also be cooled internally as well, using a closed loop in known fashion.

The parting agent can be added to the cooling medium and applied along with the latter.

The invention will now be described in greater detail with reference to the following embodiments in schematic form:

Figure 1:
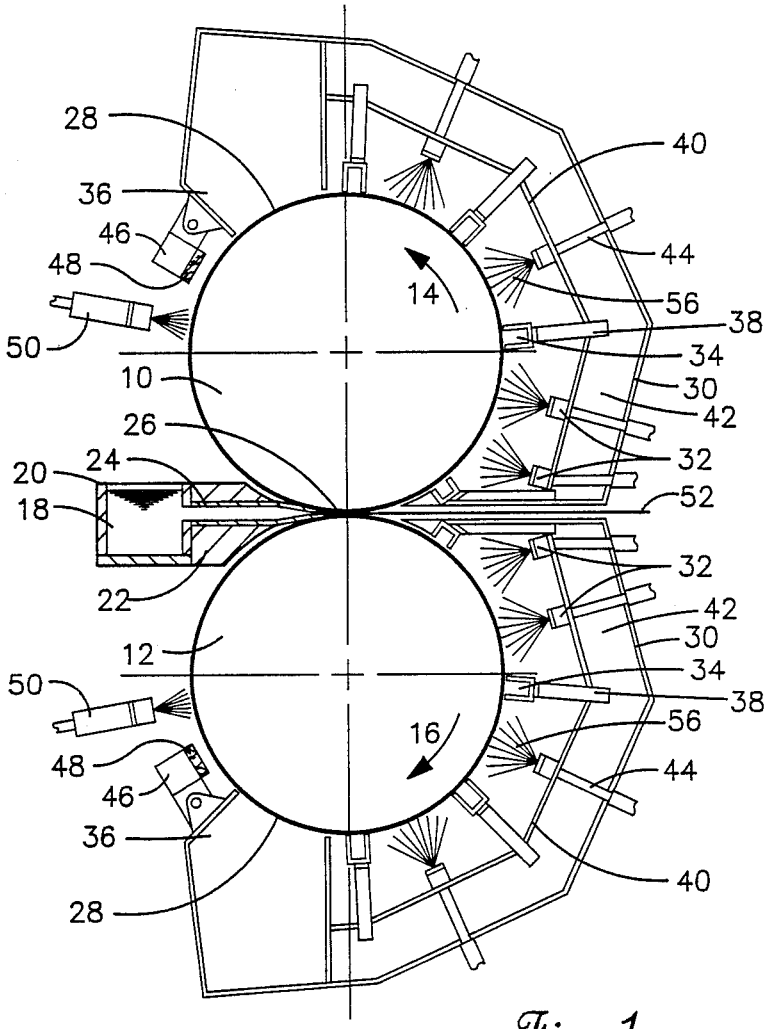
FIG. 1 is an arrangement for strip casting aluminum, with a hood.

The installation shown in FIG. 1 for casting aluminum comprises two rolls 10 and 12 which rotate in the direction of arrows 14 and 16. Liquid metal 18 is added to a pouring spout 20 and flows through a pouring nozzle 24 supported by a nozzle holder 22 into roll nip 26.

Surface 28 of each roll 10 and 12 is partially covered by a device for cooling the rolls which extends from the vicinity of roll nip 26. This device consists essentially of a hood 30 with a combination of spray nozzles 32 for cooling medium 56 and suction elements 34, as well as a drying chamber 36, all of which extend at least over the entire length of the rolls.

Suction elements 34 are strips U-shaped in cross section, with the opening facing roll surface 28, and closed off laterally. Suction stubs 38 terminate in a peripheral jacket area 42 separated by a partition 40, in which area the vacuum that creates the suction is produced, and in which the cooling medium drawn off, especially water, collects and is carried away by a drain tube, not shown.

Feed lines 44 to spray nozzles 32 pass through jacket area 42. Cooling medium is fed to these feed lines individually through one line or through common lines, not shown.

The device shown in FIG. 1 for cooling rolls with spray nozzles arranged alternately and suction elements carries away a great deal of energy from roll surface 28. The effective seal also ensures that no cooling medium, especially water, comes in contact with metal strip 52, composed of aluminum in this case.

A cleaning bar 46, connected pivotably to drying chamber 36, in other words to the end of hood 30 away from roll nip 26, has a felt 48. Instead of the felt, another material can be mounted on cleaning bar 46. In addition to performing its function of cleaning residue off the roll, the cleaning bar also evenly distributes special parting agents that may also have been applied beforehand.

In the present example, special parting agents and/or lubricants are applied downstream from cleaning bar 46 by nozzles 50.

The cooling medium, water for example, a rolling oil, an emulsion, or a suspension, can be supplied through all nozzles 32 in the same composition and quantity, and at the same temperature. As shown above, the parameters can also be combined with one another freely so that the intensity of the cooling increases in the direction of arrows 14 and 16.

The arrangement shown in FIG. 2 for rolling a metal strip 52, in the present case a steel strip, differs from the arrangement in FIG. 1, apart from the metal feed, as follows:

- a cleaning brush 54 to remove rolled-stock particles is mounted on the roll downstream from drying chamber 36, and
- the parting agent is sprayed along with cooling medium 56 onto roll surface 28.

Cleaning brush 54 removes the parting agent applied with cooling medium 56 either not at all or only to a slight extent; instead, it is uniformly spread.

Figure 2:
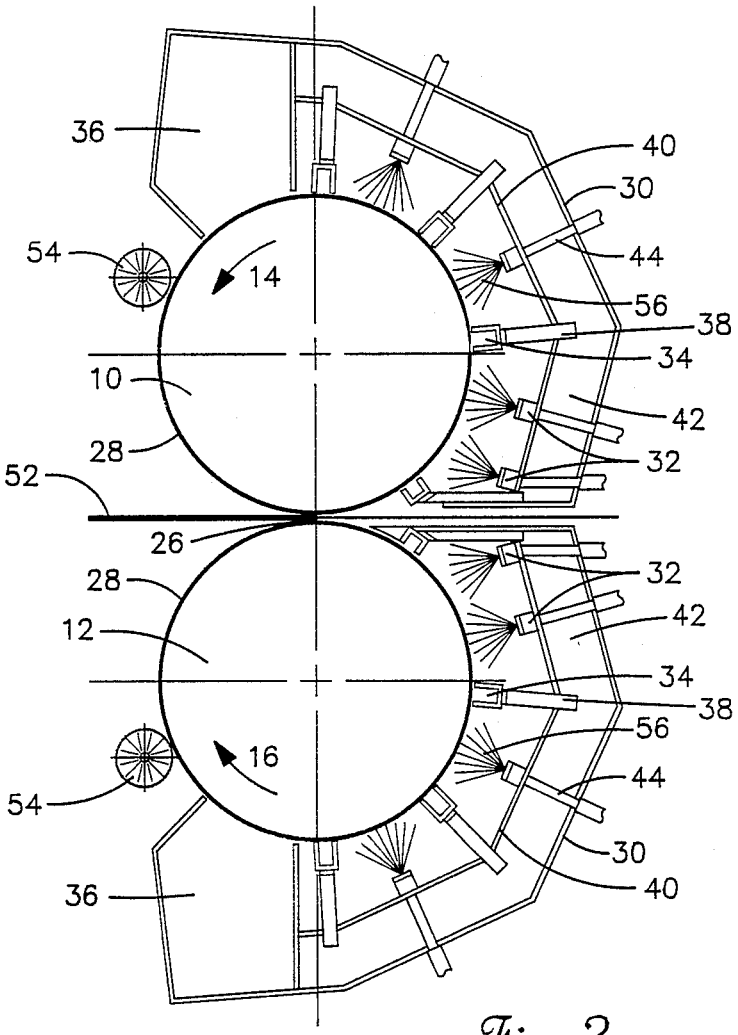
FIG. 2 is an arrangement for rolling steel, with a hood.
Figure 3:
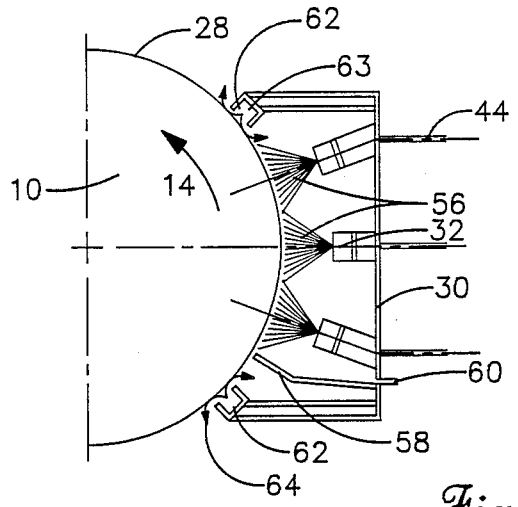
FIG. 3 is a device for cooling rolls in which the roll surface is cooled with increasing intensity in the direction away from the roll nip.

FIG. 3 shows a hood 30 in which, in contrast to FIGS. 1 and 2, no vacuum is generated. Coolant 56, preferably water, is fed through a feed line 44 to nozzle 32, which, as cannot be seen in FIG. 3, is designed as a spray nozzle. A guide strip that acts as a wiper 58, likewise extending over the entire length of roll 10, conducts the vast majority of the water to a drain 60. Pressure chambers 62 with compressed-air nozzles or slots 63 are provided at both ends of hood 30. Escape of the remaining cooling medium 56 is effectively prevented by blowing compressed air 64 into these specially designed pressure chambers.

Figure 4:
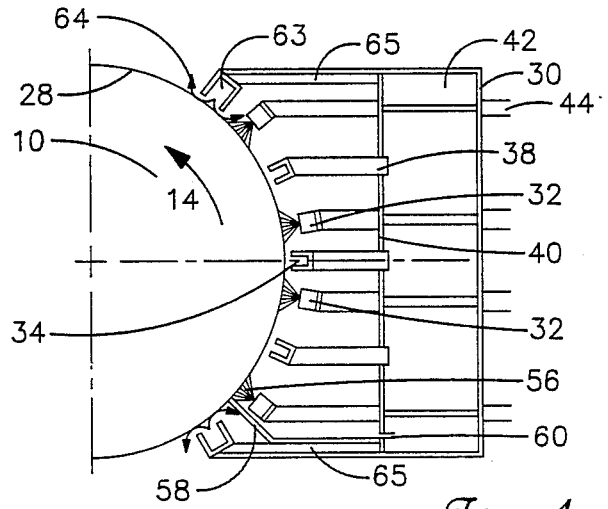
FIG. 4 is a variation of FIG. 3.

The device shown in FIG. 4 for cooling rolls consists of a hood 30 with a vacuum and a jacket area 42 separated by a partition 40 in which suction stubs 38 of suction elements 34 terminate.

In the two lower feed lines 44, a mixture of water and air is supplied as cooling medium 56; water only is supplied through the two upper feed lines 44. Thus roll supplied through the two upper feed lines 44. Thus roll surface 28 is cooled gently at first, then more markedly, in the direction away from the roll nip. The water supplied by upper spray nozzle 32 is removed by suction elements 34, and the water from lower spray nozzle 32 by a wiper 58 from roll surface 28 and guided to jacket area 42, whence it flows away through a drain 60. Compressed air is supplied by compressed-air tubes 65 with nozzles 63, mounted endwise, and roll surface 28 is dried completely.

Figure 5:
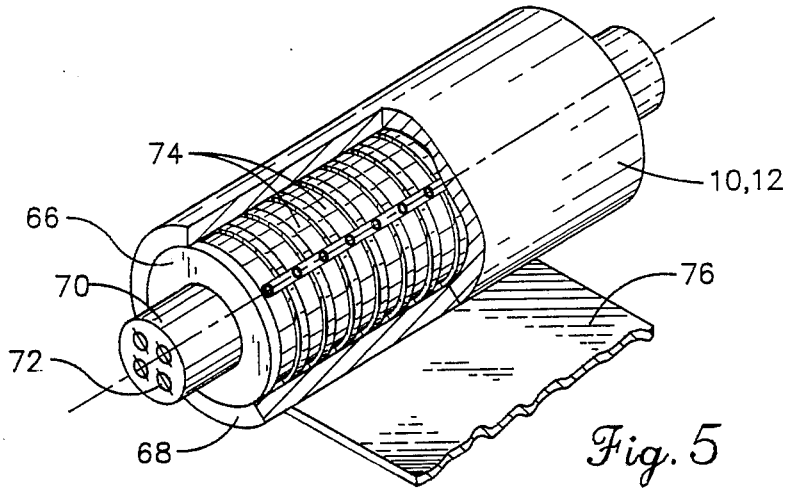
FIG. 5 is a roll with radial internal cooling.

Roll 10 and 12 shown in FIG. 5 for strip casting metals is made in two parts. It consists of a roll core 66 and a roll jacket 68. The cooling medium is supplied through roll pin 70 and carried away through holes 72. The cooling medium is carried radially into the surface area in a closed loop, where it is guided in circumferential cooling grooves 74 in roll core 66, delimited by roll jacket 68. The cast strip is labelled 76.

Figure 6:
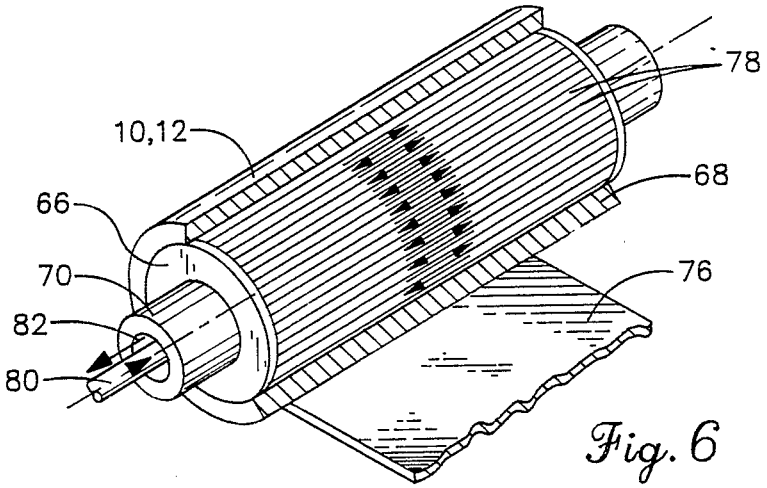
FIG. 6 is a roll with axial internal cooling.

In contrast to FIG. 5, in FIG. 6 cooling grooves 78 run axially and utilize the countercurrent principle. The cooling medium is fed by a pipe 80 into roll pin 70 and flows in an annular chamber 82 delimited by pipe 80 and a coaxial bore in roll pin 70.

The variants shown in FIGS. 5 and 6 for internal cooling are known of themselves, and together with the external cooling according to the invention, document, for example, the usable embodiments of internally cooled rolls.

Figure 7:
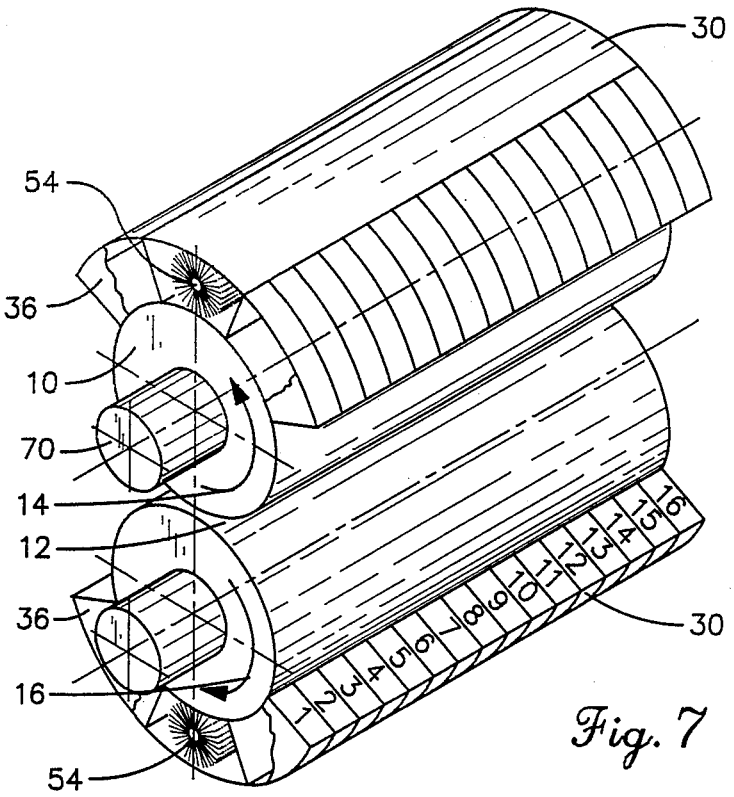
FIG. 7 shows a hood divided radially into 16 chambers for devices for cooling rolls.

Hoods 30 shown in FIG. 7 are designed as zone coolers; they divide the hood into chambers 1–16 in the axial direction. The cooling medium can be fed separately to each of the sixteen individual chambers. This allows the temperature profile to be influenced in the axial direction. Since a temperature profile changes the roll diameter accordingly, the zone cooling shown can be used to influence the strip profile transversely to the rolling or casting direction. This method of influencing the strip is known from rolling mills; it corresponds, however, to external cooling without sealing. The variation of the effect of the cooling medium is produced by regulating the amount, the temperature, and/or the thermal capacity of the coolant. Fig. 7 also shows that cleaning brush 54 can also be located upstream of drying chamber 36.

The device according to the invention and the method for cooling rolls are used primarily for removing heat during solidification in roll casting and for carrying away the heat created by shaping and friction when rolling metals. The device and the method can also be used, however, in similar installations for processing non-metallic materials such as plastics, paper, rubber, etc.

Although the present invention has been described with reference to certain embodiments, it should be appreciated that further modifications can be effected within the spirit and scope of the invention as limited only by the appended claims.

What is claimed is:

1. A device for cooling the surfaces of a first and a second roll, each said roll rotating to form a nip between said rolls, said rolls useful in rolling metals or continuous strip casting, said device comprising:

a first and a second hood, said first hood extending concentrically from the vicinity of the roll nip around a portion of said first roll, said second hood extending concentrically from the vicinity of the roll nip around a portion of said second roll, each said hood having a nip end and a downstream end, and each said hood containing:

(a) at least three pair of alternately arranged spray means and first removal means, said spray means for supplying a cooling medium to said roll surface and said first removal means for removing said cooling medium from said roll surface, said spray means comprising at least one spray device extending substantially along the axial expanse of said roll, said first removal means being at least one member selected from the group consisting of suction elements, wipers and compressed air nozzles and slots;

(b) a second removal means for removing said cooling medium wherein said second removal means is located at said nip end of said hood, said second removal means selected from the group consisting of suction elements and compressed air nozzles and slots;

(c) a third removal means for removing said cooling medium, wherein said third removal means is located at said downstream end of said hood, said third removal means selected from the group consisting of suction elements and compressed air nozzles and slots; and (d) a drainage or suction device for removal of said cooling medium collecting in said hood.

2. The device according to claim 1, wherein each of said hoods is radially divided into chambers.

3. The device according to claim 2, wherein each of said hoods is divided into at least three chambers.

4. The device according to claim 1, wherein said removal means extend substantially along the axial extent of said roll.

5. The device according to claim 1, wherein said downstream end of each said hood further comprises a drying chamber open toward said roll surface, said chamber supplying air to dry said roll surface.

6. The device according to claim 1, wherein said downstream end of said hood further comprises a cleaning and distributing device.

7. The device according to claim 6, wherein said cleaning and distributing device is selected from the group consisting of a brush and and a bar.

8. The device according to claim 1, wherein a spray device is located downstream of said hood downstream end, said spray device useful for applying a material selected from the group consisting of a parting agent, a lubricant, and a parting agent and a lubricant.

9. The device according to claim 1, wherein at least one removal means comprises at least one suction element and each said hood further comprises a peripheral jacket containing a vacuum, said vacuum in fluid communication with said suction element.

10. In a device for cooling surfaces of a first and second roll, each said roll rotating to form a nip between said rolls, said rolls useful in rolling metals or continuous strip casting, said device having a first and a second hood, said first hood extending concentrically from the vicinity of the roll nip along a portion of said first roll, said second hood extending concentrically from the vicinity of the roll nip along a portion of said second roll, each said hood having a nip end and a downstream end, each said hood having a combination of spray means for supplying a cooling medium to said roll surface, first removal means for removing said cooling medium from said roll surface, and a drainage or suction device for removal of cooling medium collecting in the hood, wherein the improvement in each hood comprises:

(a) at least three pair of said spray means and said first removal means, said spray means and said first removal means arranged alternately in the direction of rotation, said spray means comprising at least one spray device extending substantially along the axial expanse of said roll, said first removal means comprising at least one member selected from the group consisting of suction elements, wipers and compressed air nozzles and slots;

(b) second removal means located at the hood nip end and selected from the group consisting of suction elements and compressed air nozzles and slots; and (c) third removal means located at the hood downstream end and selected from the group consisting of suction elements and compressed air nozzles and slots.

11. The device according to claim 10, wherein said removal means extend substantially along the axial extent of said roll.

12. The device according to claim 10, wherein said downstream end of each said hood further comprises a drying chamber open toward said roll surface, said chamber supplying air to dry said roll surface.

13. The device according to claim 10, wherein said downstream end of each said hood further comprises a cleaning and distributing device.

14. The device according to claim 13, wherein said cleaning and distributing device is selected from the group consisting of a brush and a bar.

15. The device according to claim 10, further comprising a spray device located downstream of said hood downstream end, said spray device useful for applying a material selected from the group consisting of a parting agent, a lubricant, and a parting agent and lubricant.

16. The device according to claim 10, wherein each said hood is divided radially into chambers.

17. The device according to claim 16, wherein each said hood is divided into at least three chambers.

18. The device according to claim 10, wherein at least one removal means comprises at least one suction element and said hood further comprises a peripheral jacket containing a vacuum, said vacuum in fluid communication with said suction element.

19. A device for cooling the surfaces of a first and a second roll, each said roll rotating to form a nip between said rolls, said rolls useful in rolling metals or continuous strip casting, said device comprising:

a first and a second hood, said first hood extending concentrically from the vicinity of the roll nip around a portion of said first roll, said second hood extending concentrically from the vicinity of the roll nip around a portion of said second roll, each said hood having a nip end and a downstream end, and each said hood containing:

(a) at least two pair of alternately arranged spray means and first removal means, said spray means for supplying a cooling medium to said roll surface and said first removal means for removing said cooling medium from said roll surface, said spray means comprising at least one spray device extending substantially along the axial expanse of said roll, said first removal means being at least one member selected from the group consisting of suction elements and compressed air nozzles and slots;

(b) a second removal means for removing said cooling medium wherein said second removal means is located at said nip end of said hood, said second removal means selected from the group consisting of suction elements and compressed air nozzles and slots;

(c) a third removal means for removing said cooling medium, wherein said third removal means is located at said downstream end of said hood, said third removal means selected from the group consisting of suction elements and compressed air nozzles and slots; and (d) a drainage or suction device for removal of said cooling medium collecting in said hood.

20. The device according to claim 19, wherein said removal means extend substantially along the axial extent of said roll.

21. The device according to claim 19, wherein said downstream end of each said hood further comprises a drying chamber open toward said roll surface, said chamber supplying air to dry said roll surface.

22. The device according to claim 19, wherein said downstream end of said hood further comprises a cleaning and distributing device.

23. The device according to claim 22, wherein said cleaning and distributing device is selected from the group consisting of a brush and and a bar.

24. The device according to claim 19, wherein a spray device is located downstream of said hood downstream end, said spray device useful for applying a material selected from the group consisting of a parting agent, a lubricant, and a parting agent and a lubricant.

25. The device according to claim 19, wherein each said hood is divided radially into chambers.

26. The device according to claim 25, wherein each said hood is divided into at least three chambers.

27. The device according to claim 19, wherein at least one removal means comprises at least one suction element and each said hood further comprises a peripheral jacket containing a vacuum, said vacuum in fluid communication with said suction element.

28. In a device for cooling surfaces of a first and second roll, each said roll rotating to form a nip between said rolls, said rolls useful in rolling metals or continuous strip casting, said device having a first and a second hood, said first hood extending concentrically from the vicinity of the roll nip along a portion of said first roll, said second hood extending concentrically from the vicinity of the roll nip along a portion of said second roll, each said hood having a nip end and a downstream end, each said hook having a combination of spray means for supplying a cooling medium to said roll surface, first removal means for removing said cooling medium from said roll surface, and a drainage or suction device for removal of cooling medium collecting in the hood, wherein the improvement in each hood comprises:

(a) at least two pair of said spray means and said first removal means, said spray means and said first removal means arranged alternately in the direction of rotation, said spray means comprising at least one spray device extending substantially along the axial expanse of said roll, said first removal means comprising at least one member selected from the group consisting of suction elements and compressed air nozzles and slots;

(b) second removal means located at the hood nip end and selected from the group consisting of suction elements and compressed air nozzles and slots; and (c) third removal means located at the hood downstream end and selected from the group consisting of suction elements and compressed air nozzles and slots.

29. The device according to claim 28, wherein said removal means extend substantially along the axial extent of said roll.

30. The device according to claim 28, wherein said downstream end of each said hood further comprises a drying chamber open toward said roll surface, said chamber supplying air to dry said roll surface.

31. The device according to claim 28, wherein said downstream end of each said hood further comprises a cleaning and distributing device.

32. The device according to claim 31, wherein said cleaning and distributing device is selected from the group consisting of a brush and a bar.

33. The device according to claim 28, further comprising a spray device located downstream of said hood downstream end, said spray device useful for applying a material selected from the group consisting of a parting agent, a lubricant, and a parting agent and lubricant.

34. The device according to claim 28, wherein each said hood is divided radially into chambers.

35. The device according to claim 34, wherein each said hood is divided into at least three chambers.

36. The device according to claim 28, wherein at least one removal means comprises at least one suction element and said hood further comprises a peripheral jacket containing a vacuum, said vacuum in fluid communication with said suction element.

37. A method for cooling surfaces of a first roll and a second roll, said rolls rotating to form a nip between said rolls, said rolls useful in rolling metals or continuous strip casting, said method comprising the steps of:

(a) providing a first hood extending concentrically from the vicinity of the roll nip over a portion of said first roll and a second hood extending concentrically from the vicinity of said roll nip over a portion of said second roll, each said hood having a nip end and a downstream end;

(b) providing in each said hood at least three pair of alternately arranged cooling medium spray means and first removal means, said spray means comprising at least one spraying device extending substantially along the axial extent of each said roll, said first removal means selected from the group consisting of suction elements, wipers and compressed air nozzles and slots;

(c) increasing the rate of heat removal from each said roll surface progressively in the direction of rotation of each said roll;

(d) removing said cooling medium with a second removal means from each said roll surface at said hood nip end, said second removal means selected from the group consisting of suction elements and compressed air nozzles and slots;

(e) removing said cooling medium with a third removal means from each said roll surface at said hood downstream end, said third removal means selected from the group consisting of suction elements and compressed air nozzles and slots; and (f) removing said cooling medium collecting in said hood by a drainage or suction device.

38. The method of claim 37, wherein said step (c) comprises a method selected from the group consisting of:

(a) applying an increasing amount of a cooling medium;

(b) applying cooling media having progressively greater thermal capacity;

(c) applying cooling media having progressively decreasing temperatures; and (d) a combination of methods (a), (b) and (c).

39. The method of claim 37, wherein said step (c) comprises applying an increasing amount of a cooling medium.

40. The method of claim 37, wherein said step (c) comprises applying cooling media having progressively greater thermal capacity.

41. The method of claim 37, wherein said step (c) comprises applying cooling media having progressively decreasing temperatures.

42. The method of claim 37, wherein said step (c) comprises applying an increasing amount of cooling media having progressively greater thermal capacity.

43. The method of claim 37, wherein said step (c) comprises applying an increasing amount of cooling media having progressively decreasing temperatures.

44. The method of claim 37, wherein said step (c) comprises applying cooling media having progressively greater thermal capacity and having progressively decreasing temperatures.

45. The method of claim 37, wherein said step (c) comprises applying an increasing amount of cooling media having progressively greater thermal capacity and having progressively decreasing temperatures.

46. The method of claim 37, wherein said step (c) comprises sequentially applying air, and air-water mixture, water and then drying air in the direction of rotation of said roll.

47. The method of claim 37, further comprising the step of internally cooling said rolls.

48. A method for cooling surfaces of a first roll and a second roll, said rolls rotating to form a nip between said rolls, said rolls useful in rolling metals or continuous strip casting, said method comprising the steps of:

(a) providing a first hood extending concentrically from the vicinity of the roll nip over a portion of said first roll and a second hood extending concentrically from the vicinity of said roll nip over a portion of said second roll, each said hood having a nip end and a downstream end;

(b) providing in each said hood at least two pair of alternately arranged cooling medium spray means and first removal means, said spray means comprising at least one spraying device extending substantially along the axial extent of each said roll, said first removal means selected from the group consisting of suction elements and compressed air nozzles and slots;

(c) increasing the rate of heat removal from each said roll surface progressively in the direction of rotation of each said roll;

(d) removing said cooling medium with a second removal means from each said roll surface at said hood nip end, said second removal means selected from the group consisting of suction elements and compressed air nozzles and slots;

(e) removing said cooling medium with a third removal means from each said roll surface at said hood downstream end, said third removal means selected from the group consisting of suction elements and compressed air nozzles and slots; and (f) removing said cooling medium collecting in said hood by a drainage or suction device.

49. The method of claim 48, wherein said step (c) comprises a method selected from the group consisting of:

(a) applying an increasing amount of a cooling medium;

(b) applying cooling media having progressively greater thermal capacity;

(c) applying cooling media having progressively decreasing temperatures; and (d) a combination of methods (a), (b) and (c).

50. The method of claim 48, wherein said step (c) comprises applying an increasing amount of a cooling medium.

51. The method of claim 48, wherein said step (c) comprises applying cooling media having progressively greater thermal capacity.

52. The method of claim 48, wherein said step (c) comprises applying cooling media having progressively decreasing temperatures.

53. The method of claim 48, wherein said step (c) comprises applying an increasing amount of cooling media having progressively greater thermal capacity.

54. The method of claim 48, wherein said step (c) comprises applying an increasing amount of cooling media having progressively decreasing temperatures.

55. The method of claim 48, wherein said step (c) comprises applying cooling media having progressively greater thermal capacity and having progressively decreasing temperatures.

56. The method of claim 48, wherein said step (c) comprises applying an increasing amount of cooling media having progressively greater thermal capacity and having progressively decreasing temperatures.

57. The method of claim 48, wherein said step (c) comprises sequentially applying air, an air-water mixture, water and then drying air in the direction of rotation of said roll.

58. The method of claim 48, further comprising the step of internally cooling said rolls.

* * * * *

UNITED STATES PATENT AND TRADEMARK OFFICE

CERTIFICATE OF CORRECTION

PATENT NO. : 4,934,444

DATED : June 19, 1990

INVENTOR(S) : Frischknecht, et al.

It is certified that error appears in the above-identified patent and that said Letters Patent is hereby corrected as shown below:

Column 4, lines 50-51, please delete "Thus roll supplied through the two upper lines 44."

Column 8, Claim 28, line 30, please delete "hook" and insert -- hood -- therefor.

Column 10, Claim 46, line 13, please delete "and" and insert -- an -- therefor.

Signed and Sealed this

Fourteenth Day of May, 1991

*Attest:*

*Attesting Officer*

HARRY F. MANBECK, JR.

*Commissioner of Patents and Trademarks*